United States Patent [19]

Heinbaugh et al.

[11] 3,971,075

[45] July 27, 1976

[54] SWIMMING POOL STRUCTURE

[76] Inventors: Kenneth D. Heinbaugh, 144 Canterbury Road - South, Charlotte, N.C. 28211; Carl F. Seibert, Jr., 3208 Frederick Place, Charlotte, N.C. 28210

[22] Filed: May 8, 1974

[21] Appl. No.: 467,894

[52] U.S. Cl. ..... 4/172.19; 52/278; 52/403; 52/461; 52/468; 52/471; 52/496; 52/758 J

[51] Int. Cl.[2] ..... E14H 3/18; E04C 2/00; F16B 5/00

[58] Field of Search ..... 4/172.19, 172, 172.17, 4/172.18; 52/276, 278, 461, 468, 395, 403, 496, 588, 758 D, 758 J, 471, 417; 428/46, 52, 53

[56] References Cited

UNITED STATES PATENTS

| | | | |
|---|---|---|---|
| 3,192,538 | 7/1965 | Walter | 4/172.19 |
| 3,427,662 | 2/1969 | Jacuzzi et al. | 4/172.19 |
| 3,508,369 | 4/1970 | Tennison | 52/461 |
| 3,570,205 | 3/1971 | Payne | 52/403 |
| 3,641,595 | 2/1972 | Viessmann | 4/172.19 |
| 3,760,544 | 9/1973 | Hawes et al. | 52/468 |
| 3,846,850 | 11/1974 | Banchi | 4/172.19 |

*Primary Examiner*—Richard E. Aegerter
*Assistant Examiner*—Steven L. Stephan
*Attorney, Agent, or Firm*—Bell, Seltzer, Park & Gibson

[57] ABSTRACT

A fluid tight enclosure suitable for use as a swimming pool positioned either above or below ground level, or for relining an existing pool. The enclosure comprises a plurality of waterproof panels forming the side walls and floor, the panels being sealably interconnected by a structure which includes a resilient elastomeric sealing member bridging the adjacent panels and sealably contacting the front faces thereof. A relatively rigid plastic cover member overlies the sealing member, and in one embodiment of the disclosed invention, a relatively rigid plastic base member is positioned to underlie the sealing member, the base member including an upwardly directed flange adapted to operatively engage a conforming portion of the cover member to secure the cover member in it position overlying the sealing member.

25 Claims, 17 Drawing Figures

SWIMMING POOL STRUCTURE

The present invention relates to a fluid tight enclosure suitable for use as a swimming pool, fluid storage tank, or the like and which includes a paneled wall construction.

In constructing conventional swimming pools, having a paneled wall construction, it is common to employ a one-piece flexible liner of vinyl plastic sheet material for sealing the water therein. Such liners are difficult to assemble however, since they are heavy and bulky, and are easily cut or torn.

It is an object of the present invention to provide a relatively inexpensive paneled fluid tight enclosure suitable for use as a swimming pool, and which employs a novel sealing structure between adjacent panels which obviates the need for a separate liner.

It is a more particular object of the present invention to provide a swimming pool which may be constructed from a series of aligned panels forming both the side walls and floor thereof, the panels being waterproof and sealed along the adjacent side edges with an elongated resilient sealing member bridging the adjacent panels so as to accommodate variations in the spacing between the panels and also permit limited relative movement between the panels during use.

It is another object of the present invention to provide a paneled swimming pool which may be easily and quickly assembled, and which may be used either above or below ground level.

It is a further object of the present invention to provide a paneled fluid tight enclosure which is suitable for use in relining an existing pool.

It is still another object of the present invention to provide a novel fluid tight joint assembly for use in a swimming pool or the like and which includes an elongated resilient plastic sealing member and a relatively rigid plastic cover member overlying the sealing member to protect and improve the appearance thereof.

These and other objects and advantages of the present invention are achieved in the embodiments illustrated herein by the provision of a fluid tight enclosure which comprises a generally flat floor and vertical side walls extending about the periphery of the floor. The vertical side walls comprise a plurality of waterproof panels having side edges extending parallel to each other, and an elongated resilient sealing member bridging the adjacent side panels and sealably contacting the front faces thereof to seal the adjacent side edges of the panels. The floor comprises a plurality of similar waterproof panels which are disposed in side by side and end to end relationship to define a latticework of adjacent edges, and means are provided for sealing the adjacent edges of the floor panels, and for sealing the lower edges of each side wall panel with the adjacent floor panels.

Some of the objects of the invention having been stated, other objects will appear as the description proceeds, when taken in connection with the accompanying drawings, in which FIG. 1 is a perspective view of a fluid tight enclosure embodying the features of the present invention;

Figure 1:
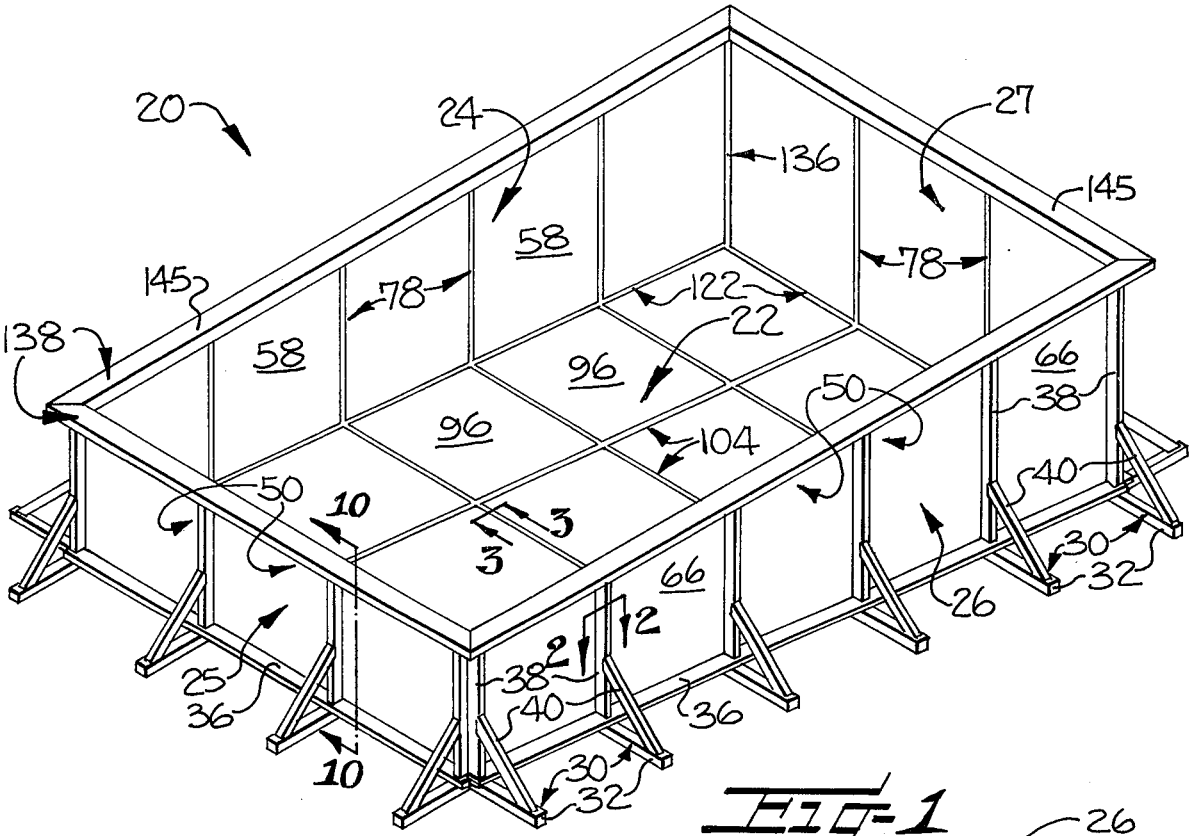

Referring more specifically to the drawings, a fluid tight enclosure in the form of a swimming pool and embodying the features of the present invention is indicated generally at 20 in FIG. 1. The pool includes a generally flat floor 22, and four vertical side walls 24, 25, 26 and 27 extending about the periphery of the floor.

Figure 3:
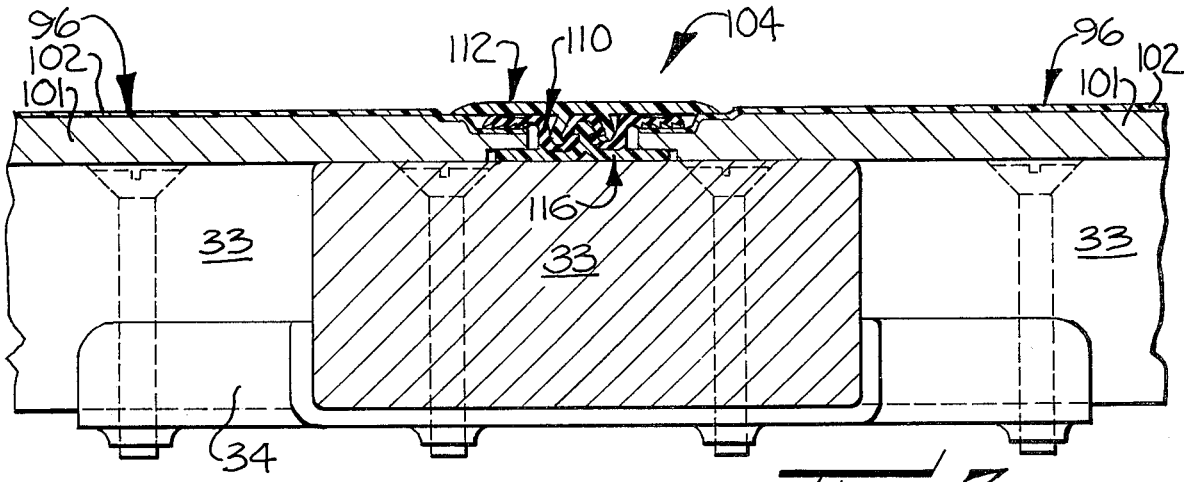
FIG. 3 is a sectional side view of the floor of the enclosure and taken substantially along the line 3—3 of FIG. 1.
Figure 10:
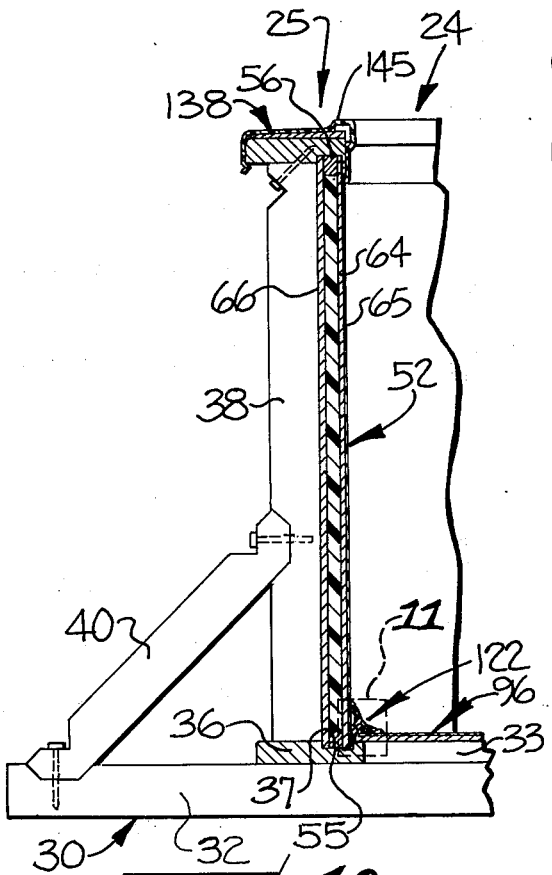
FIG. 10 is a sectional side elevational view of the side wall of the enclosure and taken substantially along the line 10—10 of FIG. 1.

The pool is positioned on a supporting foundation which comprises a plurality of horizontal beams 30 extending transversely below the side walls, the beams 30 comprising, for example, wooden 4 × 4's extending between about 18 to 24 inches on each side of the vertical side wall to define the outwardly extending end portions 32 visible in FIG. 1. The supporting foundation further includes a rectangular latticework of interconnected horizontal joists 33 underlying and supporting the floor 22. The joists 33 may comprise for example wooden 2 × 4's, and as seen in FIG. 10, the ends of the joists 33 rest upon the horizontal beams 30 adjacent the side walls, and the remainder of the latticework rests upon the supporting ground. In addition, the interconnection of the joists 33 may be facilitated by the X-shaped metal connectors 34 as seen in FIG. 3, and the rectangular space between the joists 33 may be filled with sand or the like (not shown) to provide an underlying generally flat surface at a level corresponding to the upper surface of the joists 33.

Figure 2:
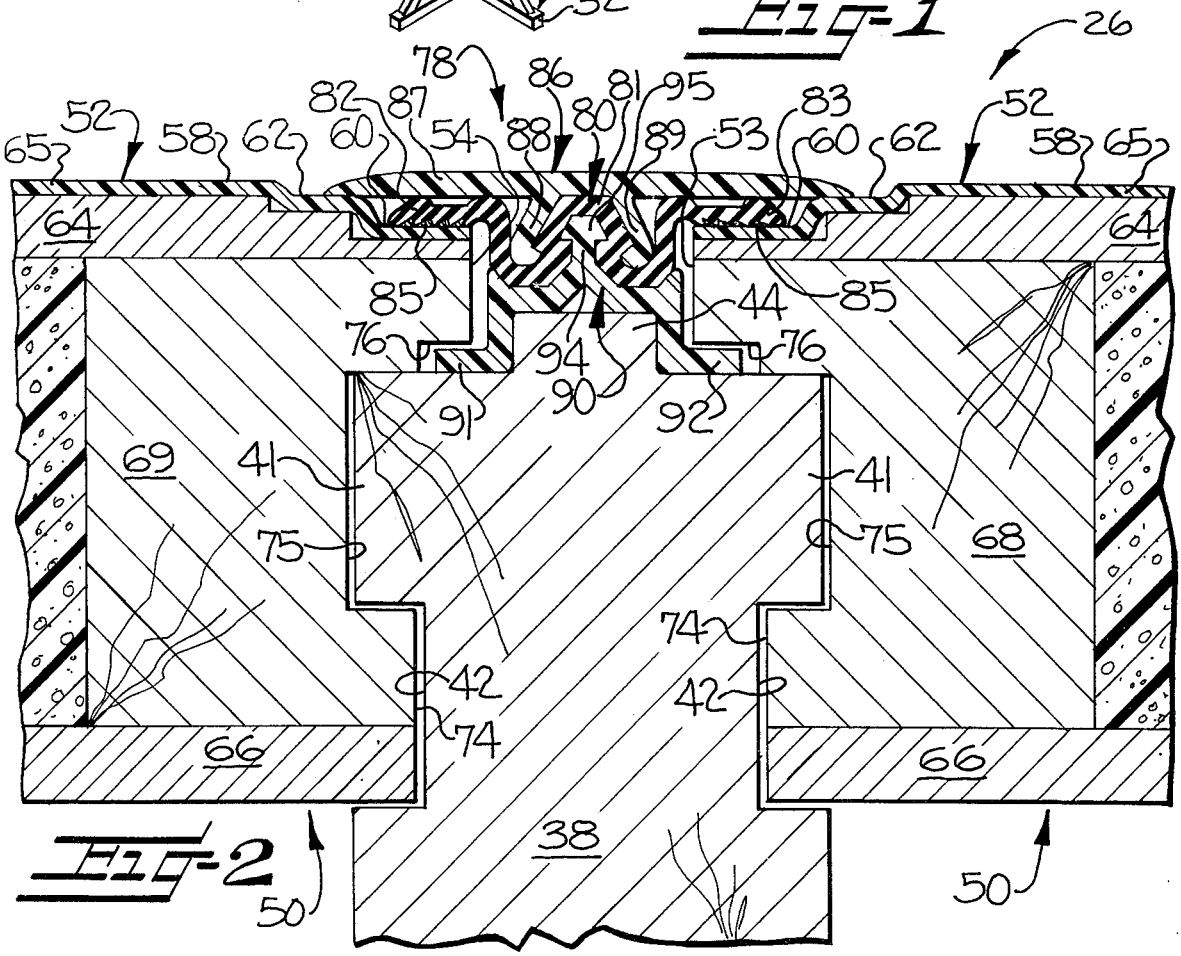
FIG. 2 is an enlarged sectional top plan view of the side wall of the enclosure and taken substantially along the line 2—2 of FIG. 1.

The vertical side walls 24–27 each include a horizontal member 36 transversely overlying the beams 30 and extending along the full length of the wall. The member 36 comprises, for example, a wooden 2 × 6, and includes a longitudinal channel 37 along the upper surface. A plurality of vertically directed posts 38 rest upon the members 36, with each post 38 overlying a beam 30. An inclined knee brace 40 extends between each end portion 32 of the beam and the associated post 38 to thereby add rigidity to the vertical side walls. As best seen in FIG. 2, each side face of the vertical posts 38 has a vertically directed tongue 41 and groove 42, and the front face includes a rectangular abutment 44.

Each vertical side wall further includes a plurality of coplanar waterproof composite wall segments 50, with one of the wall segments 50 being disposed between each adjacent pair of vertically directed posts 38. Each composite wall segment comprises a rectangular side panel 52 which defines two vertical side edges 53, 54, each extending parallel to the adjacent side edge of the adjacent panel (note FIG. 2). Each panel 52 further defines a lower end edge 55 (note FIG. 11), a top end edge 56 (note FIG. 12), and a generally planar front face 58. Viewing FIG. 2, the front face is seen to define a forwardly facing edge portion extending along the length of each of the vertical side edges, the edge portions each including a first segment 60 of reduced thickness and lying below the plane of the front face 58, and a second segment 62 lying at a level intermediate that of the first segment 60 and the front face 58.

The side panels 52 may be fabricated from any waterproof material, such as metal or fiberglass, or as illustrated they may comprise a sheet of plywood 64 and an overlying sheet of plastic 65 such as vinyl. The vinyl sheet 65 may be suitably colored, and may be bonded to the plywood in any conventional manner, such as by the use of an adhesive. Such bonding may be effected either prior to subsequent to the assembly of the pool as hereinafter further described.

The composite wall segments 50 further comprise a rear panel 66 disposed parallel to and laterally spaced from the associated side panel 52, and a pair of vertical spacer blocks 68, 69 extend along the side edges of the panel. In addition, a bottom spacer block 70 extends along the bottom end edge of the segment 50, and a top spacer block 71 extends along the top end edge (note FIG. 10). The space between the side panel and rear panel of the segments may be filled with a rigid foamed plastic material, such as foamed polyurethane, to add further rigidity to the structure and without significantly increasing the weight. Also, the panels may by adhered to the spacer blocks by any suitable means, such as by the use of an adhesive or nails, to form the composite segment 50.

As seen in FIG. 2, the exposed edges of the spacer blocks 68 and 69 have a stepped cross-sectional configuration defining a tongue 74 and groove 75 which matingly conform to the tongue 41 and groove 42 of the post 38. Also, a rearwardly facing channel 76 is positioned in each spacer block below the first segment 60 of the edge portion of the side panels 52. From the above, it will be apparent that the composite wall segments 50 may be fixedly positioned between the adjacent posts by vertically sliding the composite segment between the posts with the tongue 74 and groove 75 of the spacer block overlying the conforming tongue 41 and groove 42 of the posts 38.

Also as seen in FIG. 2, the adjacent side edges 53 and 54 of the adjacent side panels 52 are spaced from each other to define a gap therebetween. To form a seal between the adjacent side panels, there is provided a sealing joint assembly 78 comprising an elongated resilient sealing member 80 which bridges the adjacent side panels and sealably contacts the front faces thereof. The sealing member 80 extends along the length of the side edges as will be apparent from FIG. 1, and the sealing member includes a convoluted or W-shaped medial portion 81 and a pair of laterally directed extensions 82 and 83 respectively. Each of the extensions sealably contacts the forwardly facing edge portion of one of the adjacent side panels to form a seal therebetween, and more particularly, the extensions 82 and 83 overlie the first segment 60. The sealing member is preferably fabricated from a clear or translucent elastomeric material, and the under surfaces of the extensions 82 and 83 are serrated and coated with a layer of clear or translucent pressure sensitive adhesive 85 to adhere the sealing member to the panels as hereinafter further described.

A relatively rigid cover member 86 overlies the resilient sealing member and includes a generally flat upper portion 87 extending laterally beyond the extensions of the sealing member and contacting the second segment 62 of the edge portion of the side panels 52. The cover member 86 further includes a pair of integral downwardly directed laterally spaced arms 88 and 89 for the purposes hereinafter set forth.

A relatively rigid base member 90 underlies the sealing member 80, and as shown in FIG. 2, is configured to conform to the outline of the rectangular abutment 44 of the post 38. Also, the base member 90 includes lateral side arms 91 and 92 extending into the channels 76 of the spacer blocks 68 and 69. The base member 90 further includes an upwardly directed flange 94 having a generally T-shaped cross-section to define a bulbous end 95. As seen in FIG. 2, the spaced arms 88 and 89 of the cover member substantially surround the bulbous end 95 of the flange, and the medial portion 81 of the sealing member is positioned intermediate the flange 94 and laterally spaced arms 88 and 89. By this arrangement, the cover member 86 is secured in its position overlying the sealing member 80 to thereby maintain the assembly of the cover member and sealing member with the adjacent side panels.

The resilient sealing member 80 may be fabricated from a variety of thermoplastic elastomers, such as the polyvinyl chloridenitrile rubber compound blends, styrene-butadiene block polymer elastomers, flexible polyurethanes, or plasticized polyvinyl chloride. Such materials look like rubber and are desirable in that they can be readily extruded, and rubber compounds suitable for longterm water immersion may also be used. A material of this type is sold under the trademark "Pliotuf" by the Goodyear Tire and Rubber Company. The cover member 86 and the base member 90 are preferably formed with a relatively rigid plastic material such as unplasticized polyvinyl chloride, and which also may be readily extruded. Also, the cover member 86 may be heavily pigmented, for example with titanium dioxide, to screen ultraviolet light from the sealing member 80. A suitable polyvinyl chloride of this type is sold under the trademark "Pliovic" by the Goodyear Tire and Rubber Company.

The floor 22 of the pool shown in FIGS. 1 and 3 comprises a plurality of waterproof, rectangular floor panels 96, each panel 96 having two side edges 98 and 99, two end edges (not numbered) and an upper front face 100. The panels are disposed in side by side and end to end relationship to define a latticework of adjacent edges as best seen in FIG. 1. The floor panels 96 are similar in construction to the side panels 52, and may be fabricated from any suitable waterproof material such as metal, fiberglass, or as illustrated, plywood 101 covered with a vinyl sheet 102.

The means for sealing the adjacent edges of the floor panels comprises a joint assembly 104 as illustrated in FIGS. 3–8. As will become apparent, the joint assembly 104 is generally similar to the above side wall joint assembly 78. Specifically, the floor panels 96 each include a forwardly facing edge portion which includes a first segment 105 lying below the plane of the remainder of the upper face 100, and a second segment 106 lying at a level intermediate that of the first segment and the remainder of the upper face. Also, a channel 108 is provided in the rearwardly facing edge portion of the panel and beneath the first segment 105. The joint assembly 104 further comprises an elongated resilient sealing member 110 bridging the adjacent floor panels and sealably contacting the upper faces thereof along the first segment 105. Arelatively rigid cover member 112, having a generally flat upper portion 113 and downwardly directed spaced arms 114 and 115, overlies the sealing member and extends laterally beyond the sealing member and contacts the upper face of the floor panels along the second segment 106 such that the upper portion 113 is substantially coplanar with the remainder of the front face. The relatively rigid base member 116 includes lateral side arms 117 and 118 overlying the rearwardly facing edge portion and received within the channels 108.

Figure 4:
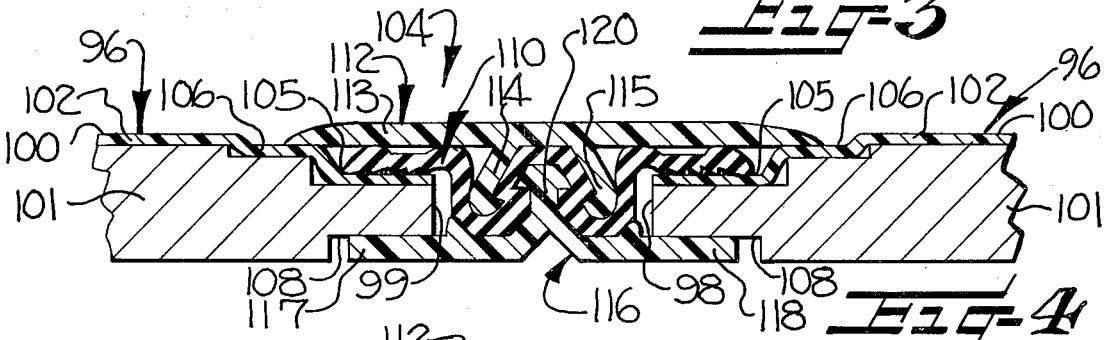
FIG. 4 is an enlarged sectional view of the fluid tight joint assembly shown in FIG. 3.
Figure 5:
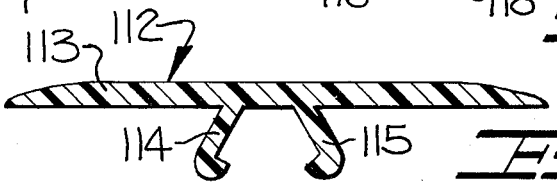
FIG. 5 is a sectional view of the cover member of the joint assembly shown in FIG. 4.
Figure 6:
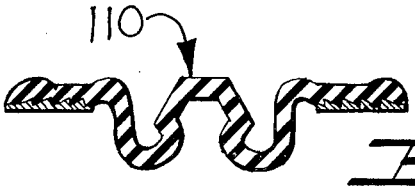
FIG. 6 is a sectional view of the sealing member of the joint assembly of FIG. 4.
Figure 7:
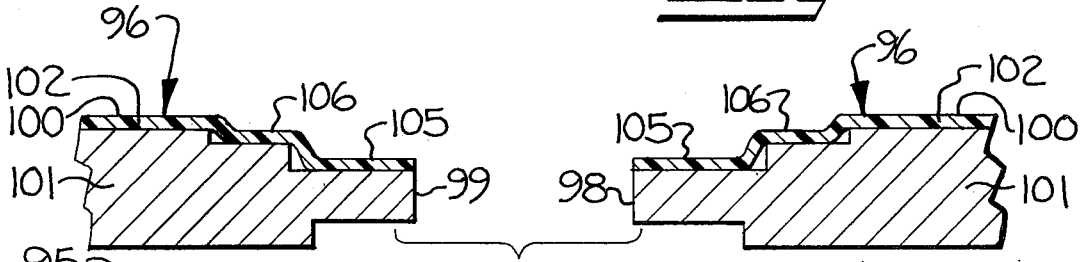
FIG. 7 is a sectional view of the adjacent panels of the joint assembly shown in FIG. 4.
Figure 9:
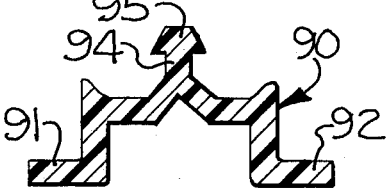
FIG. 9 is a sectional view of the base member of the joint assembly shown in FIG. 2.
Figure 8:
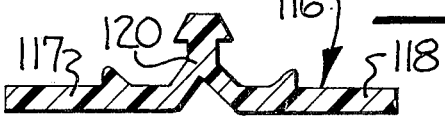
FIG. 8 is a sectional view of the base member of the joint assembly shown in FIG. 4.

The base member 116 includes an upwardly directed flange 120, and as will be apparent from FIGS. 3 and 4, the flange 120 is operatively engaged by the downwardly directed arms 114, 115 of the cover member 112 to maintain the assembly of the cover member and sealing member with the adjacent panels. Also, it will be apparent from FIG. 1 that the above described joints 104 extend in two directions on the floor 22, thereby forming a number of joint intersections. Such intersections will be described in more detail hereinafter with reference to the embodiment shown in FIG. 16.

Figure 11:
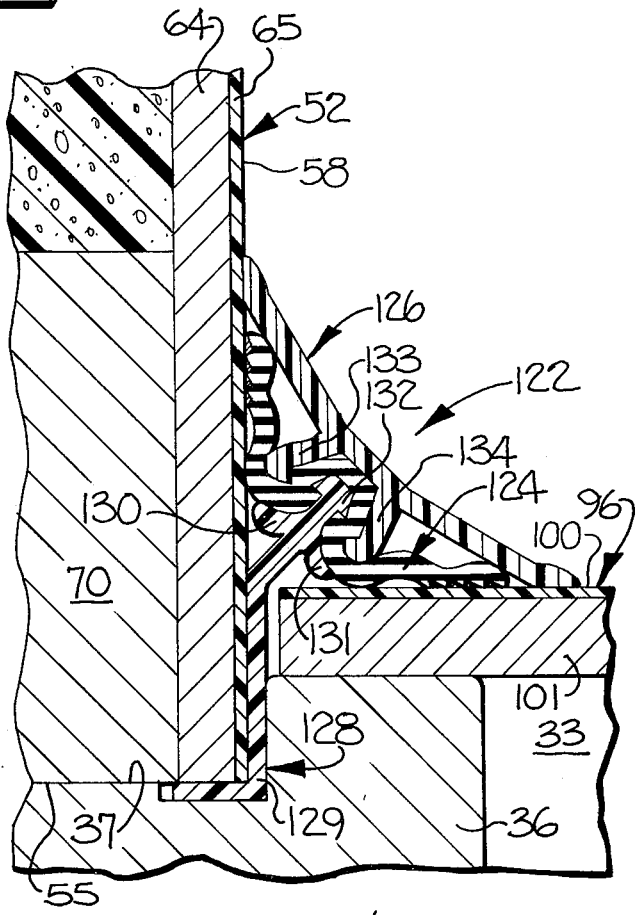
FIG. 11 is an enlarged sectional side elevational view of the edge joint for sealing the side panels of the wall with the floor, and as shown in the box 11 of FIG. 10.

The means for sealing the lower end edge of each side panel 52 with the floor 22 is illustrated in FIGS. 10 and 11. As shown, the sealing means comprises an edge joint assembly 122 comprising an elongated resilient sealing member 124 bridging the side panel 52 and the adjacent floor panels 96, and sealably contacting the front face 58 and upper face 100 thereof respectively. A cover member 126 overlies the sealing member 124 and extends laterally beyond the sealing member to also contact the front face of the side panels and the upper face of the floor panels. A base member 128 is positioned below the sealing member 124 and cover member 126, the base member 128 including a downwardly directed L-shaped extension 129 which extends below and underlies the bottom end edge 55 of the side panels 52. Also, the base member 128 includes lateral extensions 130 and 131 adapted to underlie the medial portion of the sealing member 124. As in the case of the previous embodiments, the base member 128 includes an upwardly directed flange 132 in which is adapted to be operatively engaged by the laterally spaced arms 133, 134 of the cover member 126 to maintain the assembly of the cover member and sealing member with the adjacent panels.

A corner joint assembly 136 is provided at each of the four corners for sealing the side edges of the associated side panels. The joint assembly 136 is generally similar to the structure shown in FIG. 14, and will be described in more detail hereinafter with reference to the description of the embodiment shown in that Figure. Also, it will be apparent that the intersections of the various joint assemblies 78, 104, 122, and 136 as shown in FIG. 1 may be sealed by the use of a suitable caulking material or the like after the assembly of the pool has been completed and as hereinafter further described.

Figure 12:
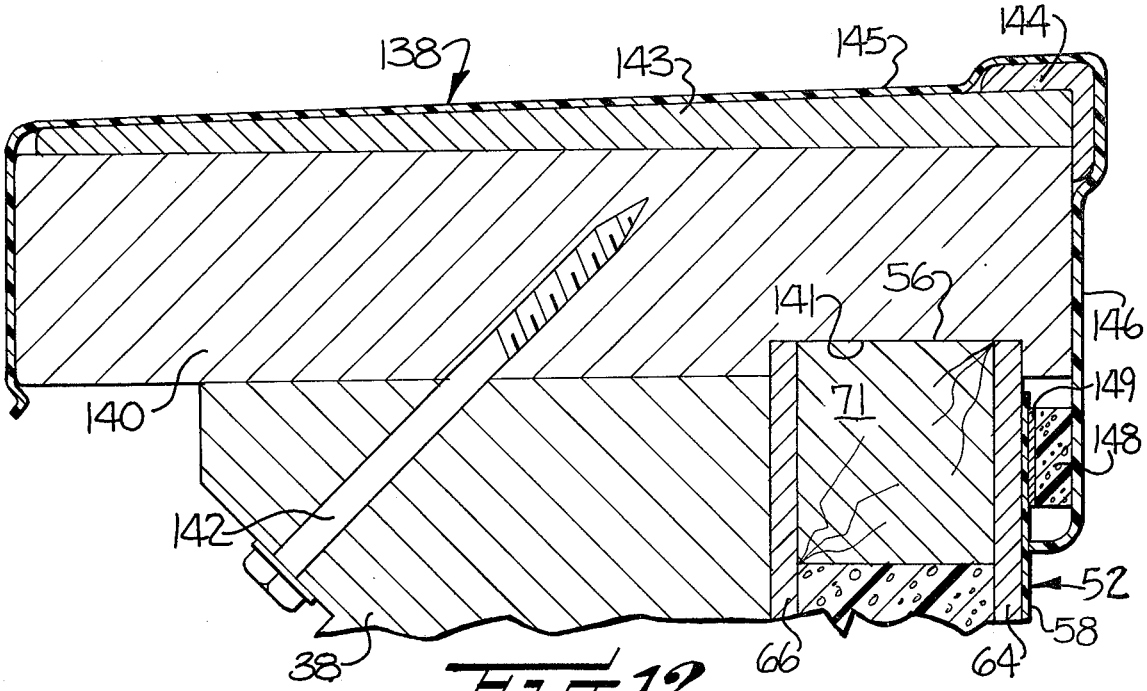
FIG. 12 is an enlarged sectional side elevational view of the upper portion of the side wall as shown in FIG. 10.

As seen in FIGS. 1 and 12, a coping 138 overlies the top edge of the composite wall segments 50 and is supportingly carried by the posts 38 as best seen in FIG. 12. In particular, the coping includes a horizontal platform member 140 which generally conforms in size and configuration to the lower horizontal member 36. The under surface of the platform member 140 includes a channel 141 to receive the top end edge of the composite wall segment therein, the remaining portion of the under surface resting upon the posts 38 and secured thereto by means of the threaded fastener 142. A shingle 143 having a tapered cross-section is positioned on the top side of the platform member, and an angled corner protective member 144 is carried along the front upper edge thereof. An extruded vinyl sheet 145 overlies the coping, the sheet 145 having a downwardly extending front edge 146 which overlies the top end edge 56 and a portion of the front face 58 of the associated side panel 52. A strip of sponge material 148 is interposed between the vinyl sheet of the coping at 146 and the front face 58 of each side wall panel to prevent any fluid contained in the pool from entering therebetween. The sponge strip 148 may be adhesively secured to the panel 52 by the layer of adhesive 149.

From the above description, it will be apparent that the enclosure illustrated in FIGS. 1–12 may be essentially prefabricated, and may be readily assembled and disassembled. To assemble the enclosure, the foundation is initially prepared either at or below ground level, by positioning the beams 30 about the periphery of the enclosure, and then positioning the overlying joists 33 in a latticework arrangement. Preferably, the latticework arrangement of the joists conforms to the outline of the floor panels 96 such that a joist 33 underlies each joint. The space between the joists may then be filled with fine gravel or sand to form a horizontal surface for supporting the floor 22.

To assemble the side walls 24–27, the horizontal members 36 are initially positioned along the periphery of the enclosure, and the vertical posts 38 and knee braces 40 are secured in position. The composite wall segments 50 may then be assembled by vertically sliding the same between the posts 38 such that the lower end of each segment is received in the channel 37 of the member 36, and with the tongue 74 and groove 75 of the segments mating with the conforming tongue 41 and groove 42 of the posts 38. Also, the base member 128 of the edge joints 122 will be positioned such that the L-shaped extension 129 underlies the lower end edge 55 of the side panel 52 as seen in FIG. 11. The floor panels 96 are then positioned upon the supporting joists 33 to form the floor 22. Normally, it is not necessary to secure the floor panels 96 to the joists, since the weight of the water or other liquid will serve to retain these members in proper position. However, the floor panels 96 could be secured to the joists by means of an adhesive or the like.

To seal the wall joints, the base member 90 is initially positioned between the side edges 53, 54 in the manner shown in FIG. 2. Preferably, the base member 90 may be secured to the associated post 38 by means of an adhesive prior to the assembly of the adjacent wall segments. Next, the resilient sealing member 80 is positioned such that the medial portion 81 receives the flange 94, and the extensions 82 and 83 overlie the first segment 60 of the side panels. As noted above, the sealing member 80 is preferably formed from a translucent elastomeric material, and the adhesive underlying the extensions 82 and 83 is also translucent. By this arrangement, the effectiveness of the seal between the extensions and the side panels can be checked during assembly of the sealing member by visually observing the appearance of the adhesive, since areas of secure contact will appear to be the color of the surface of the side panel being contacted. More particularly, when the translucent extensions are put in perfect contact with the surface of the side panels, the color of the underlying panel surface will clearly show through the extensions of the sealing member, and by observing this change in appearance, the effectiveness of the seal can be readily determined. As will be understood, the adhesive may if desired be lightly colored in a color contrasting to the color of the side panels. The serrations in the under surface of the extensions 82 and 83 serve to hold a suitable amount of the adhesive 85, and also provide means for accommodating any irregularities on the upper surface of the side panels such as may result from the presence of sand particles or dirt.

Once the sealing member 80 is in position and the effectiveness of the seal checked by observing the color showing through the extensions 82 and 83, the cover member 86 is assembled thereto by pressing the same downwardly over the medial portion of the sealing member such that the arms 88 and 89 effectively encompass the bulbous end 95 of the flange 94 of the base member. The cover member 86 thus serves to protect the sealing member 80, and also serves to improve the appearance of the joint.

Once the joint assemblies have been formed in the side walls in the manner described above, the floor joint assemblies 104 as shown in FIGS. 3–8, the edge joint assemblies 122 as shown in FIGS. 10 and 11, and the corner joint assemblies 136 are completed. The method of assembling these joint assemblies is generally similar to the above described method for assembling the joint assemblies 78, and will thus not be further described herein. Also, it will be apparent that the intersection of the various joint assemblies must be sealed, and this may be conveniently effected by the use of a suitable caulking compound.

To complete the assembly of the enclosure of FIG. 1, the coping as shown in FIG. 12 is positioned along the top of the post 38 and the wall segments 50. In this regard, the sponge strip 148 may be adhesively secured along the upper edge of the front face 58 of the side panel 52, to retain the strip in its proper position.

An additional embodiment of the present invention is shown in FIGS. 13–17. In this embodiment, the invention is particularly suitable for use in relining an existing below-the-ground pool. As shown, the enclosure includes a generally flat floor 152, and four vertical side walls 153, 154, 155 and 156 extending about the periphery of the floor. The side walls each comprise a plurality of coplanar waterproof, rectangular side panels 158, with each of the side panels including two vertical side edges 160, 161, a lower end edge (not numbered), a top end edge (not numbered), and a front face 162. As in prior embodiments, the side panels may be fabricated from any suitable waterproof material and in the illustrated embodiment comprise plywood with an overlying outer vinyl sheet. The floor 152 comprises a plurality of generally rectangular waterproof panels 164 disposed in side by side and end to end relationship to define a latticework of adjacent edges, the floor panels 164 being otherwise generally similar in construction to the side panels 158.

Figure 15:
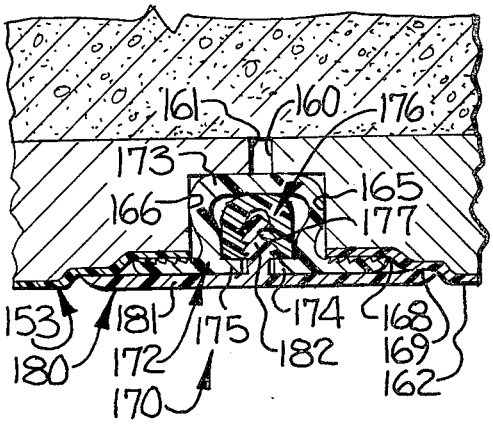
FIG. 15 is a sectional top plan view of a side wall joint and taken substantially along the line 15—15 of FIG. 13.

As seen in FIG. 15, the side edges 160 and 161 which oppositely face each other include relatively large cutouts 165 and 166, respectively, which together define a channel (not numbered) extending along the length of the side edges. Also, the edge portion of the front face 162 of the panels includes a first segment 168 and a second segment 169 as in the prior embodiments.

The adjacent side edges 160, 161 of the adjacent panels are sealed by the side wall joint assembly 170 which includes an elongated resilient sealing member 172 which bridges the adjacent side panels and sealably contacts the front faces 162 thereof. The sealing member 172 is generally similar in structure and function with the sealing members as shown in the prior embodiments, but in this case the medial portion of the sealing member defines a receptacle 173 of generally U-shaped cross-section and has a pair of inwardly directed lips 174, 175 adjacent the upper end thereof. The receptacle 173 is adapted to be positioned within the channel defined by the cut-outs 165, 166 and the lateral extensions of the sealing member sealably contact the first segments 168. An elongated relatively rigid plastic retainer 176 is positioned within the receptacle 173 and extends along the length thereof. The retainer includes ribbed lateral side walls as best seen in FIG. 15 for the purposes hereinafter set forth.

A relatively rigid plastic cover member 180 overlies the sealing member 172 and includes a generally flat upper portion 181 extending laterally beyond the sealing member and contacting the second segment 169 of the side panels as shown in FIG. 15. The cover member 180 includes a downwardly directed flange 182 having ribbed side surfaces, the ribbed side surfaces of the flange being adapted to engage the ribbed side walls of the slot 177 in the retainer to prevent upward movement of the cover member and thereby maintain the assembly of the cover member 180 and sealing member 172 with the adjacent panels.

Figure 14:
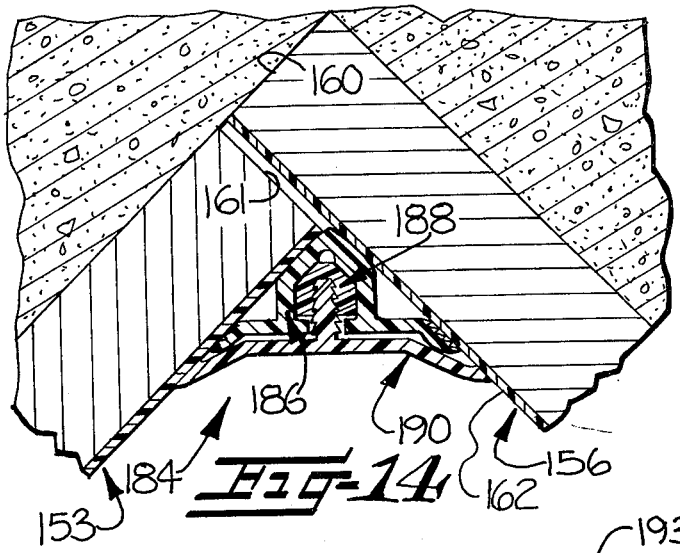
FIG. 14 is a sectional top plan view of a corner joint and taken substantially along the line 14—14 of FIG. 13.

A corner joint assembly 184 is shown in FIG. 14, and includes a sealing member 186 generally similar in configuration to that shown in FIG. 15, a retainer 188, and a cover member 190. The corner joint assembly 184 is generally similar in construction and function to that shown in FIG. 15, with the exception that the medial portion of the sealing member 186 includes a V-shaped rear edge portion to conform to the intersection of the side panels. Also, the extensions of the sealing member 186, and the outer extremity of the cover member 190, are somewhat flared to conform to the side panels.

Figure 13:
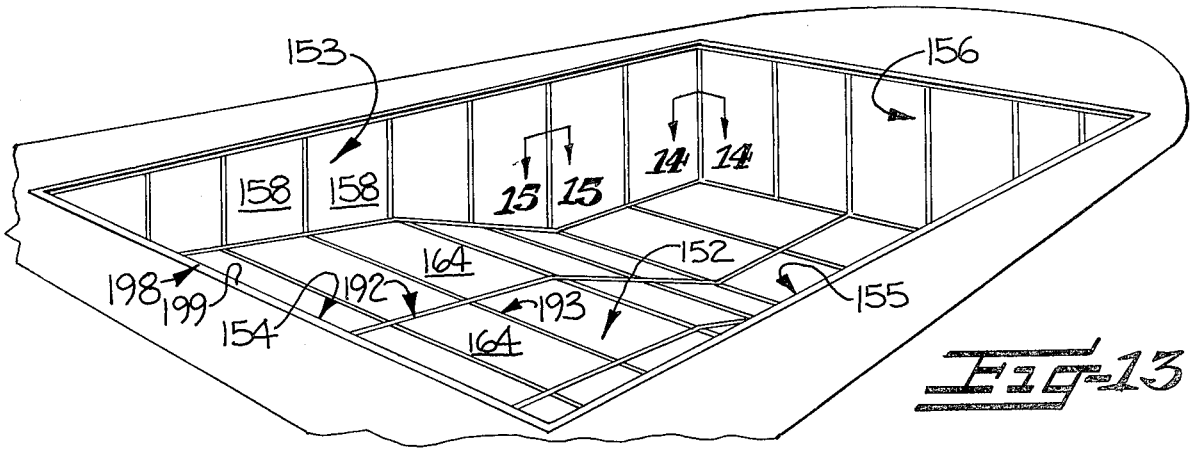
FIG. 13 is a perspective view of a below-the-ground swimming pool, and illustrating a second embodiment of the present invention.
Figure 16:
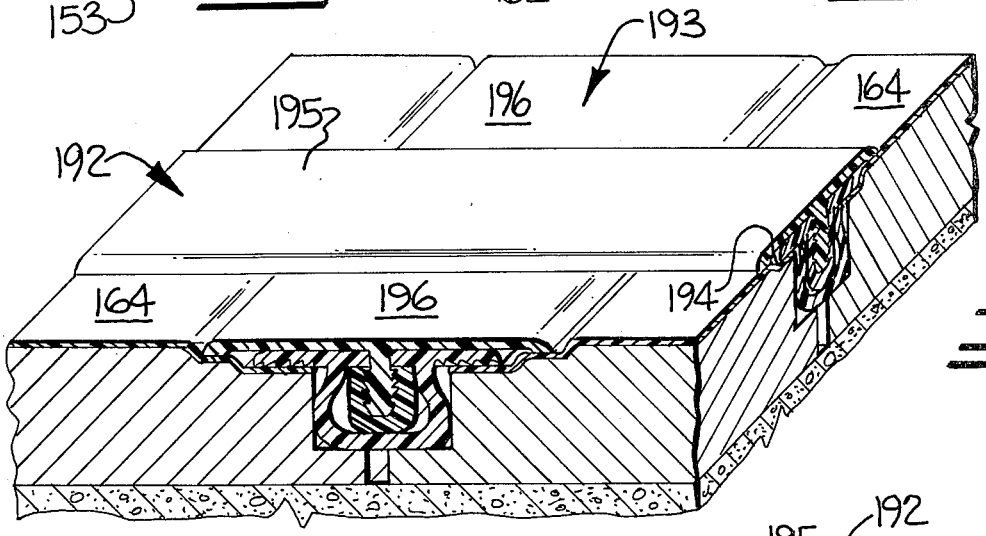
FIG. 16 is a sectioned perspective view of a portion of the pool shown in FIG. 13 and illustrating the intersection of the floor joints.
Figure 17:
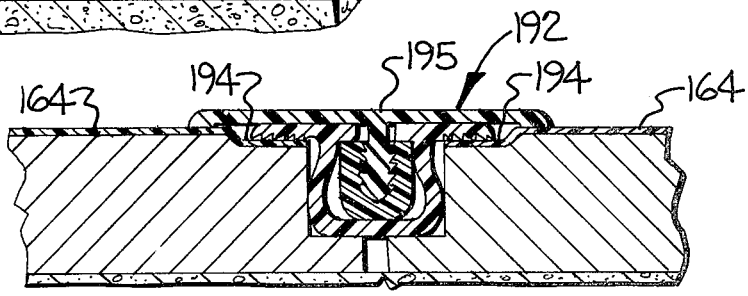
FIG. 17 is a sectional side elevational view of one of the floor joints shown in FIG. 16.

FIGS. 16 and 17 illustrate the floor joint assemblies 192 and 193 for the embodiment of the invention shown in FIG. 13, and in particular FIG. 16 illustrates the manner in which two floor joints intersect. As will be apparent, the intersecting floor joint assemblies 192 are generally similar to the assembly shown in FIG. 15, with the exception that one pair of adjacent side edges includes a single edge segment 194 (note FIG. 17) of reduced thickness, rather than two separate edge segments at different levels as in the prior embodiments.

Thus, as shown, the floor joint assembly 193 terminates at the intersection to permit the joint assembly 192 to continue thereacross uninterrupted. The cover member 195 of the joint 192, lying at a level above the cover member 196 of the joint 193, is free to pass thereover without distortion. To insure that the fluid in the enclosure will not enter at the intersection, a suitable caulking compound may be applied along the intersections of the various members.

To assemble the enclosure shown in FIGS. 13–17, the side wall panels 158 are initially secured to the existing walls by means of a suitable adhesive, or the like. Next, the floor panels 164 are positioned to form the floor, and then the various sealing joint assemblies are applied to seal the adjacent side edges of the panels and as described above. In addition, a coping 198 formed from a sheet of vinyl material or the like may be positioned to overlie the top end edges of the side wall panels 158, the coping 198 including a rearwardly extending horizontal surface 199 which serves to overlie and seal the top end edge of the panels and also improve the overall appearance of the enclosure.

While the illustrated embodiments of the present invention have been described primarily for use in connection with a swimming pool, it will be understood that the fluid tight enclosure of the present invention may be used as a fluid storage tank and other similar purposes. Also, since the plastic materials from which the illustrated enclosure is fabricated are generally non-reactive with most acids and other corrosive fluids, the present invention is particularly well suited for storing liquids of this type. Further, it will be apparent that the use of the elongated resilient sealing members in the joint assemblies of the present invention permits variations in the spacing between the adjacent panels, as well as limited relative movement between the panels during use without destroying the efficiency of the seal.

In the drawings and specification, there has been set forth a preferred embodiment of the invention, and although specific terms are employed, they are used in a generic and descriptive sense only and not for purposes of limitation.

That which is claimed is:

1. A fluid tight joint assembly suitable for use in swimming pools or the like and comprising a pair of adjacent waterproof panels, each of said panels including a side edge positioned in a predetermined orientation adjacent the side edge of the adjacent panel, a front face defining a forwardly facing edge portion extending along the length of the associated side edge, and a rear face defining a rearwardly facing edge portion extending along the length of the associated side edge and beneath said forwardly facing edge portion, an elongated resilient sealing member bridging the adjacent panels and extending along the length of the side edges thereof, said sealing member including a medial portion and pair of laterally directed extensions, each of said extensions sealably contacting the forwardly facing edge portion of one of the adjacent panels to form a seal therebetween which extends along the length of the edge portion, a relatively rigid cover member overlying said resilient sealing member and including a generally flat upper portion extending laterally beyond said sealing member and contacting the forwardly facing edge portions of the adjacent panels, and a pair of downwardly directed laterally spaced arms, and means operatively associated with said pair of arms of said cover member for securing said cover member in its position overlying said sealing member to thereby maintain the assembly of the cover member and sealing member with the adjacent panels, and including a relatively rigid base member positioned between said side edges of the panels and including lateral side arms overlying the rearwardly facing edge portion of the adjacent panels and an upright flange having a generally T-shaped cross-section to define a bulbous end, and with said arms of said cover member substantially surrounding said bulbous end of said flange to operatively engage the same and with said medial portion of said sealing member positioned intermediate said flange and arms.

2. The joint assembly as defined in claim 1 wherein said cover member and said base member are plastic, and said sealing member comprises an elastomeric material.

3. The joint assembly as defined in claim 2 wherein said base member and said cover member are constructed from unplasticized polyvinyl chloride, and wherein said cover member includes a pigment to screen ultraviolet light.

4. A fluid tight enclosure suitable for use as a swimming pool or the like and comprising a generally flat floor, means defining a vertical side wall extending about the entire periphery of said floor and comprising a plurality of waterproof, rectangular side panels, each of said side panels including two vertical side edges each extending parallel to an adjacent side edge of the adjacent panel, a front face defining a forwardly facing edge portion extending along the length of each of the side edges, and a lower end edge, means for sealing each side edge of each side panel with the adjacent side edge of the adjacent side panel and comprising an elongated resilient sealing member of translucent elastomeric material bridging each of the adjacent panels and extending along the length of the side edges thereof, each sealing member including a pair of laterally directed extensions with each of said extensions overlying one of the forwardly facing edge portions of the adjacent panels, and a layer of translucent adhesive positioned intermediate each extension and the associated forwardly facing edge portion to form a seal therebetween which extends along the length of the edge portion, and means for sealing the lower end edge of each side panel with the floor, whereby the effectiveness of the seal between the adjacent side panels may be visually checked by observing the appearance of the edge portions of the side panels which show through the extensions of the sealing member.

5. The enclosure as defined in claim 4 wherein said means for sealing each side edge of each side panel with the adjacent side edge of the adjacent side panel further comprises an elongated relatively rigid cover member overlying said resilient sealing member and including a generally flat upper portion extending laterally beyond said sealing member and contacting the front faces of the adjacent panels, and downwardly directed interengaging means, and means operatively associated with said interengaging means for securing said cover member in its position overlying said sealing member to thereby maintain the assembly of the cover member and sealing member with the adjacent panels.

6. The enclosure as defined in claim 4 wherein said floor comprises a plurality of waterproof, rectangular floor panels, each of said floor panels having two side edges, two end edges, and an upper face, said floor panels being disposed in side by side and end to end relationship to define a latticework of adjacent edges, and means for sealing the adjacent edges of said floor panels.

7. The enclosure as defined in claim 6 wherein each of said side panels comprises a sheet of plywood and an overlying sheet of plastic, and each of said floor panels comprises a sheet of plywood and an overlying sheet of plastic.

8. The enclosure is defined in claim 6 wherein said means for sealing the adjacent edges of said floor panels comprises an elongated resilient sealing member of translucent elastomeric material bridging the adjacent floor panels and sealably contacting the upper faces thereof.

9. The enclosure as defined in claim 8 wherein said means for sealing the lower end edge of each side panel with the floor comprises an elongated resilient sealing member of translucent elastomeric material bridging the side panels and adjacent floor panels and sealably contacting the front faces and upper faces thereof respectively.

10. The enclosure as defined in claim 6 further comprising a supporting foundation defining a generally flat surface, said flat surface underlying and supporting said floor, and said means defining said side walls further comprises a plurality of vertically directed posts extending upwardly from said supporting foundation and positioned in spaced apart relationship, and with one of said side panels being disposed between each adjacent pair of vertically directed posts.

11. The enclosure as defined in claim 10 wherein said supporting foundation includes a plurality of horizontal beams and with one of said horizontal beams directly underlying each of said vertically directed posts, each of said horizontal beams including an end portion extending outwardly beyond the periphery of said floor, and an inclined brace extending between each end portion and the associated post to add rigidity to said vertical side walls of the enclosure.

12. The enclosure as defined in claim 11 wherein said means defining said side walls further comprises a rear panel disposed parallel to and laterally spaced from each of said side panels, means for maintaining the spacing of the side panels and rear panels, and rigid foamed plastic material interposed between said side panels and read panels to add rigidity thereto.

13. The enclosure as defined in claim 12 wherein said means for maintaining the spacing of the side panels and rear panels comprises a vertically directed spacer block positioned along each of the two vertical side edges of each side panel, and means for interconnecting each spacer block with the associated side panel and rear panel to form a composite wall segment.

14. The enclosure as defined in claim 13 wherein each of said spacer blocks is interconnected to the adjacent post by means of a vertically directed tongue and groove interconnection such that each composite wall segment may be fixedly positioned between adjacent posts by vertically sliding the composite wall segment between the posts.

15. The enclosure as defined in claim 11 wherein each of said side panels further includes a top end edge, and said enclosure further includes a horizontal coping overlying said top end edge of each side panel and extending rearwardly therefrom and continuously about the periphery of said enclosure, and means for sealing the coping to the front face of each side panel.

16. The enclosure as defined in claim 15 wherein said means for sealing the coping to the front face of each side panel comprises a sheet of plastic overlying at least a portion of said coping and extending downwardly to overlie the top end edge and a portion of the front face of the associated side panel.

17. The enclosure as defined in claim 16 wherein a sponge material is interposed between said plastic sheet of said coping and said front face of each side wall panel to prevent any fluid contained in the enclosure from entering therebetween.

18. A fluid tight joint assembly suitable for use in swimming pools or the like and comprising a pair of adjacent waterproof panels, each of said panels including a side edge positioned in a predetermined orientation adjacent the side edge of the adjacent panel and a front face defining a forwardly facing edge portion extending along the length of the associated side edge, and an elongated resilient sealing member of translucent lastomeric material bridging the adjacent panels and extending along the length of the side edges thereof, said sealing member including a medial portion and pair of laterally directed extensions with each of said extensions overlying one of the forwardly facing edge portions of one of the adjacent panels, and a layer of translucent adhesive positoned intermediate each extension and the associated forwardly facing edge portion to form a seal therebetween which extends along the length of the edge portion, whereby the effectiveness of the seal between the adjacent panels may be visually checked by observing the appearance of the edge portions of the panels which show through the extensions of the sealing member.

19. A fluid tight joint assembly as defined in claim 18 wherein said medial portion of said sealing member has a convoluted cross-sectional configuration which is adapted to permit relative movement between the panels without loss of the integrity of the seal.

20. A fluid tight joint assembly as defined in claim 18 further comprising a relatively rigid cover member overlying said resilient sealing member and including a generally flat upper portion extending laterally beyond said sealing member and contacting the forwardly facing edge portions of the adjacent panels, and downwardly directed interengaging means, and means operatively associated with said interengaging means for securing said cover member in its position overlying said sealing member to thereby maintain the assembly of the cover member and sealing member with the adjacent panels.

21. The joint assembly as defined in claim 20 wherein said medial portion of said sealing member defines a receptacle of generally U-shaped cross section, and said means for securing said cover member includes an elongated retainer positioned within said sealing member receptacle, said retainer including an upper surface defining a slot extending along the length thereof, and said downwardly directed interengaging means of said cover member is fixedly positioned within said slot.

22. The joint assembly as defined in claim 21 wherein said receptacle includes a pair of inwardly directed lips adjacent the upper end thereof and contacting said retainer to thereby prevent upward movement of said retainer.

23. The joint assembly as defined in claim 22 wherein said slot in said retainer includes ribbed lateral side walls, and said downwardly directed interengaging means comprises a flange having ribbed side surfaces, the ribbed side walls of said slot being engaged by the ribbed side surfaces of said flange to prevent upward movement of said cover member.

24. The joint assembly as defined in claim 20 wherein said panels are coplanar, and each of said forwardly facing edge portions includes a first segment of reduced thickness such that said first portion lies below the plane of the remainder of the front face of the panels, and said laterally directed extensions of said sealing member contact said first segment.

25. The joint assembly as defined in claim 24 wherein each of said forwardly facing edge portion includes a second segment lying at a level intermediate that of said first segment and the remainder of the front face of the panels, and said cover member contacts said second segment such that said flat upper portion of said cover member is substantially coplanar with the remainder of the front face of the panels.

* * * * *

UNITED STATES PATENT OFFICE

CERTIFICATE OF CORRECTION

PATENT NO. : 3,971,075

DATED : July 27, 1976

INVENTOR(S) : Kenneth D. Heinbaugh et al

It is certified that error appears in the above-identified patent and that said Letters Patent are hereby corrected as shown below:

Column 5, Line 19, "Arelatively" should be --A relatively--.
Column 11, CLAIM 8, Line 21, "is" should be --as--; same column, Line 58, CLAIM 12, "read" should be --rear--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*